US009893480B2

(12) United States Patent
Kodaira et al.

(10) Patent No.: US 9,893,480 B2
(45) Date of Patent: Feb. 13, 2018

(54) CONNECTOR

(71) Applicant: Tyco Electronics Japan G.K., Kanagawa (JP)

(72) Inventors: Yoshihiko Kodaira, Kawasaki (JP); Hiroshi Shirai, Kawasaki (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 15/255,983

(22) Filed: Sep. 2, 2016

(65) Prior Publication Data

US 2017/0070014 A1 Mar. 9, 2017

(30) Foreign Application Priority Data

Sep. 4, 2015 (JP) ..... 2015-174353
Feb. 24, 2016 (JP) ..... 2016-033283

(51) Int. Cl.
*H01R 12/57* (2011.01)
*H01R 12/52* (2011.01)
(Continued)

(52) U.S. Cl.
CPC ..... *H01R 24/60* (2013.01); *H01R 12/716* (2013.01); *H01R 13/6278* (2013.01); *H01R 2107/00* (2013.01)

(58) Field of Classification Search
CPC ..... H01R 12/716; H01R 12/57; H01R 13/41; H01R 13/6582; H01R 13/6594; H01R 12/52; H01R 12/7082; H01R 12/73
See application file for complete search history.

(56) References Cited

U.S. PATENT DOCUMENTS 6,923,659 B2 * 8/2005 Zhang ..... H01R 12/716 439/74
7,070,423 B2 * 7/2006 Zhang ..... H01R 12/716 439/74

(Continued)

FOREIGN PATENT DOCUMENTS

JP 2010113813 A 5/2010

OTHER PUBLICATIONS

Abstract of JP2010113813, dated May 20, 2010, 2 pages.

*Primary Examiner* — James Harvey
*Assistant Examiner* — Matthew T Dzierzynski
(74) *Attorney, Agent, or Firm* — Barley Snyder

(57) ABSTRACT

A connector reduced in width and easily mated with a mating connector is provided. An insulative housing of a connector has a substantially rectangular mating face. Further, the metal shell has a base portion, a curved portion, and a supporting portion. The base portion upstands from a peripheral edge of the mating face extends along the peripheral edge and encloses the mating face circumferentially in a substantially rectangular shape. Further, the curved portion is continuous to an upper end of the base portion and curved inward in a semicircular shape for guiding the mating connector. Further, the supporting portion has a shape hanging from the curved portion toward the mating face along an inner wall face of the base portion for supporting the mating connector, so that the insulative housing does not have an upstanding wall extending along a side face of a longitudinally extending portion of the metal shell and the metal shell supports a widthwise inner face of the mating connector.

11 Claims, 10 Drawing Sheets

(51) Int. Cl.

| | |
|---|---|
| ***H01R 24/60*** | (2011.01) |
| ***H01R 12/71*** | (2011.01) |
| *H01R 13/41* | (2006.01) |
| *H01R 13/6582* | (2011.01) |
| *H01R 13/6594* | (2011.01) |
| *H01R 107/00* | (2006.01) |
| *H01R 13/627* | (2006.01) |

(56) References Cited

U.S. PATENT DOCUMENTS

| | | | | |
|---|---|---|---|---|
| 7,074,085 | B2 * | 7/2006 | Chen | H01R 23/6873 439/108 |
| 7,467,975 | B2 * | 12/2008 | Ma | H01R 13/2442 439/607.01 |
| 7,585,185 | B2 * | 9/2009 | Obikane | H01R 13/65802 439/108 |
| 8,105,112 | B2 * | 1/2012 | Midorikawa | H01R 12/716 439/607.35 |
| 8,840,407 | B2 * | 9/2014 | Nose | H01R 12/716 439/607.35 |
| 9,048,554 | B2 * | 6/2015 | Tagawa | H01R 12/707 |
| 9,240,654 | B2 * | 1/2016 | Takemoto | H01R 12/7029 |
| 9,257,766 | B2 * | 2/2016 | Takemoto | H01R 12/716 |
| 9,300,064 | B2 * | 3/2016 | Takenaga | H01R 12/716 |
| 2011/0250800 | A1 * | 10/2011 | Guo | H01R 12/716 439/660 |
| 2015/0064942 | A1 * | 3/2015 | Takemoto | H01R 12/7029 439/74 |

* cited by examiner

Fig. 5A
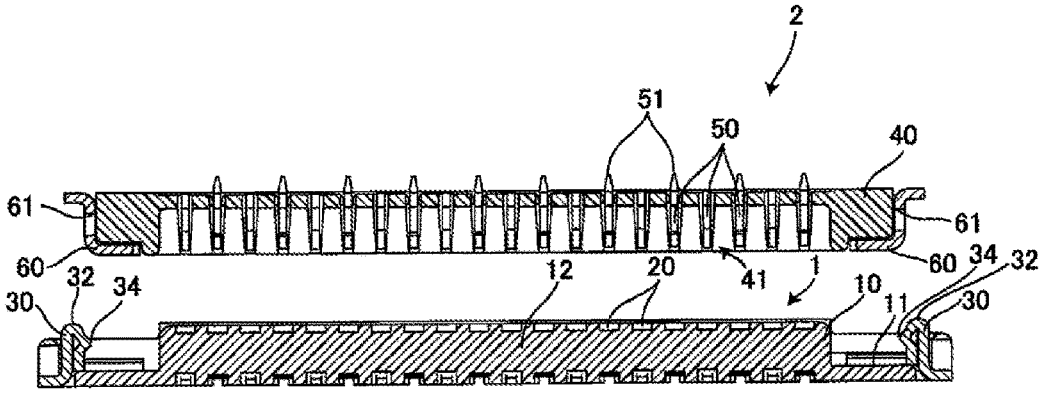
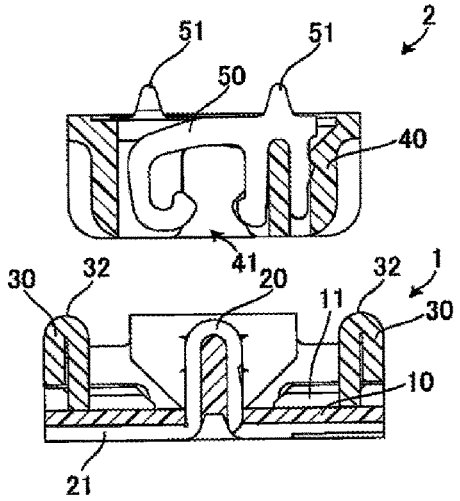
Fig. 5B

Fig. 6
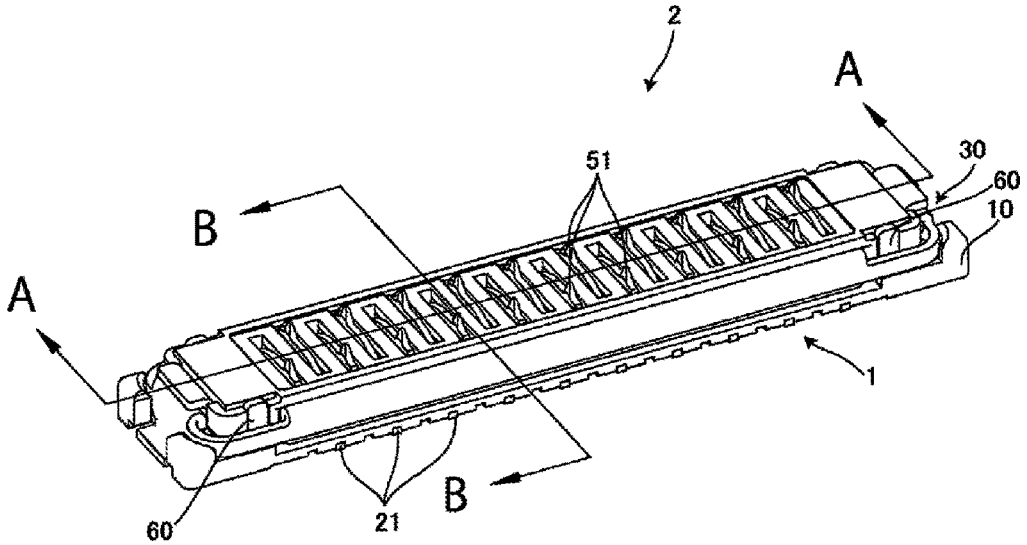
Fig. 7 A
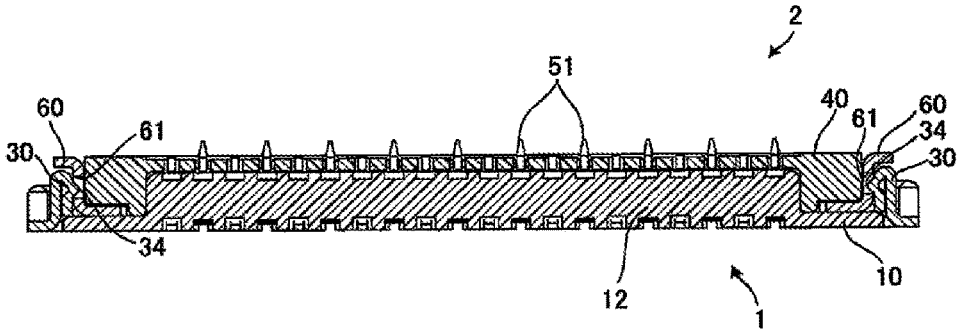
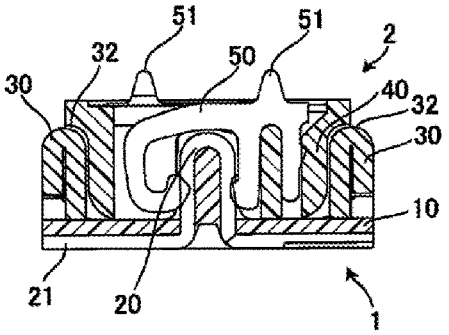
Fig. 7B

Fig. 8A
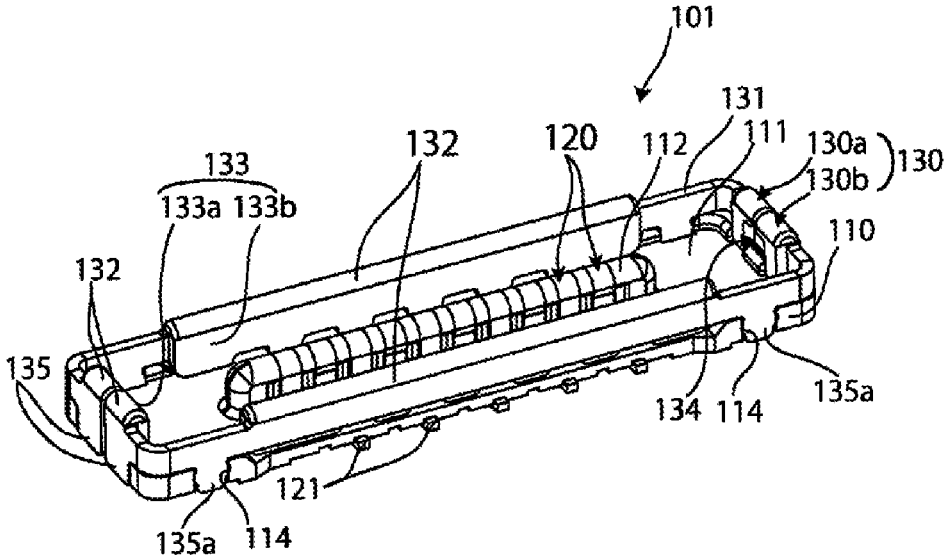
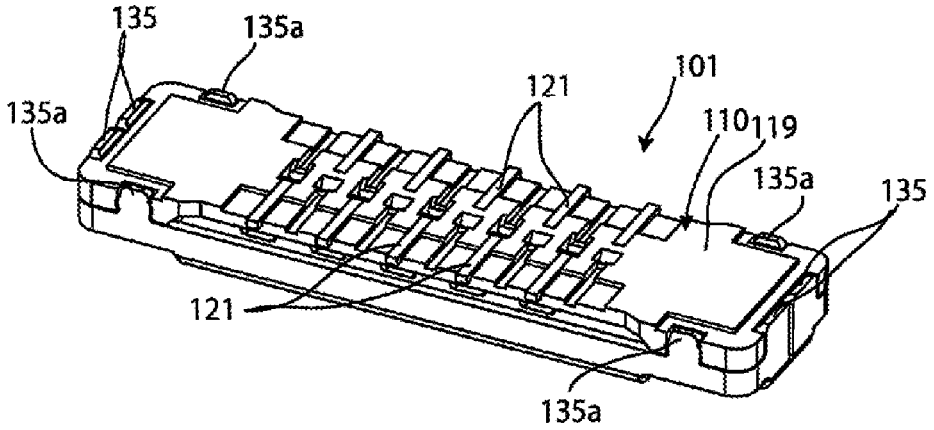
Fig. 8B

Fig. 12A
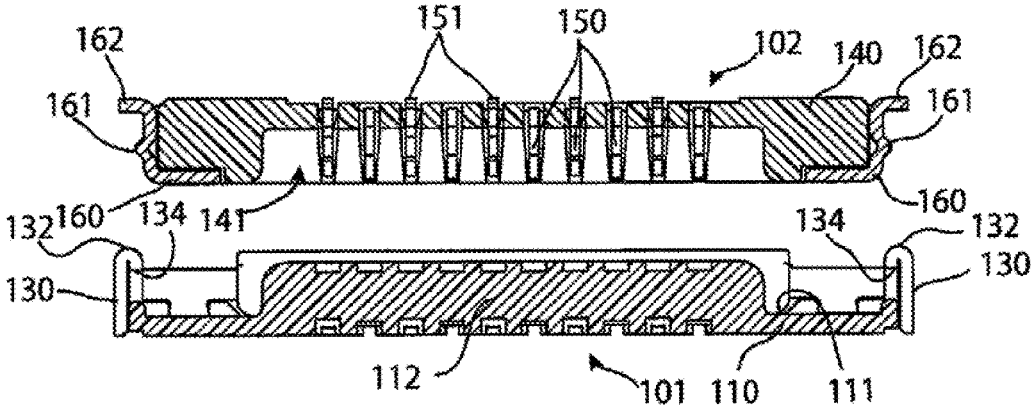
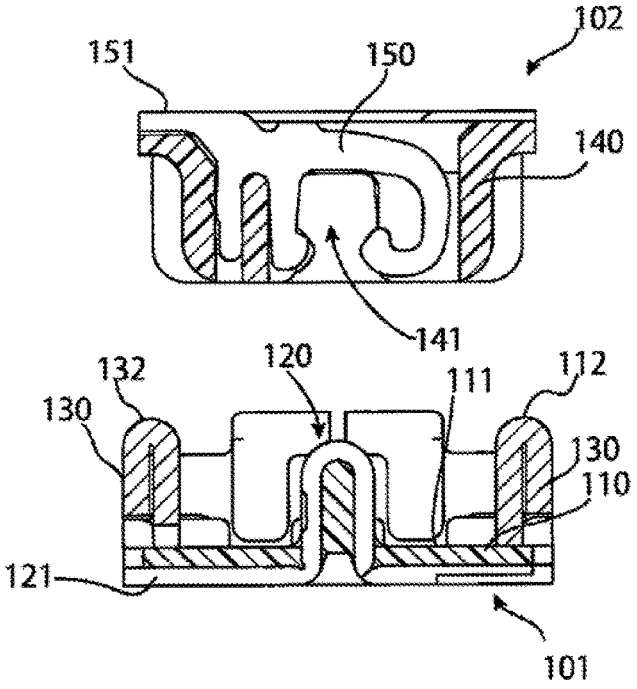
Fig. 12B

Fig. 14A
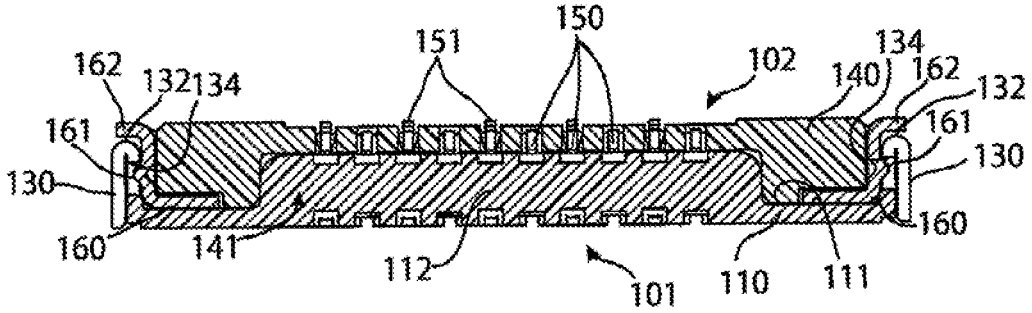
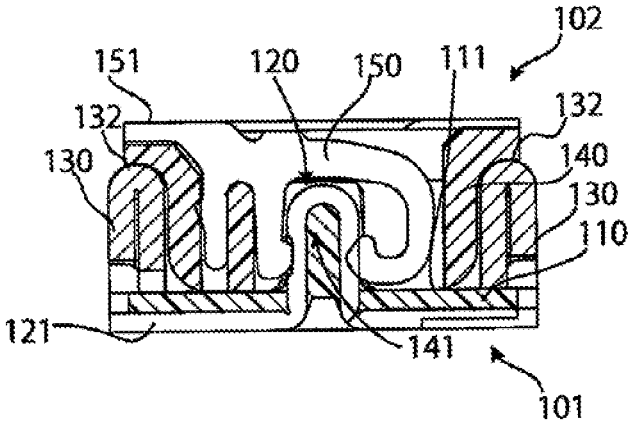
Fig. 14B

CONNECTOR

CROSS-REFERENCE TO RELATED APPLICATIONS

This application claims the benefit of the filing date under 35 U.S.C. § 119(a)-(d) of Japanese Patent Application No. 2015-174353 and Japanese Patent Application No. 2016-033283 filed Feb. 24, 2016.

FIELD OF THE INVENTION

The present invention relates to a connector suitable for connection between circuit boards.

BACKGROUND

In recent years, some uses for connectors have required a further reduction in size, a further reduction in width of the connectors. A board-to-board connector used for connection between circuit boards contained in a portable device is taken as an example. In the case of a connector for this application, a connector having tens of contacts arranged and having considerably small dimensions, for example, a length of 10 mm or less, and a width of 1.5 mm or less, is required.

In this regard, patent literature PTL1: JP2015-135806A discloses a connector provided with a housing having an upstanding wall upstanding from a mating face and a shell along a side face of the upstanding wall. For the connector disclosed, a further reduction in width of the connector is difficult because the structure of the housing constitutes an obstacle. In addition, as a reduction in size and a reduction in width of a connector advances, alignment for mating connectors with each other becomes more difficult. That is, how to make easy and safe mating possible, while achieving a reduction in size and a reduction in width, is also a problem.

In view of these circumstances, an object of the present invention is to provide a connector reduced in width and facilitating mating with a mating connector.

SUMMARY

A connector, according to the present invention, includes an insulative housing having a mating face, a plurality of contacts arranged in a longitudinal direction and supported by the insulative housing, and a metal shell adapted to support a widthwise inner face of a mating connector. The metal shell has a base portion extending along a peripheral edge of the mating face of the insulative housing. The metal shell is upstanding from the peripheral edge of the mating face of the insulative housing and encloses circumferentially the mating face of the insulative housing. The metal shell also has a curved portion continuous to an upper end of the base portion and curved inward in a semicircular shape adapted to guide a mating connector. The metal shell further has a supporting portion hanging from the curved portion toward the mating face of the insulative housing along an inner wall face of the base portion adapted to support a mating connector and extends along the peripheral edge of the mating face of the insulative housing enclosing the mating face of the insulative housing circumferentially. The connector of the present invention does not have an upstanding wall extending along a side face of a portion of the metal shell extending in the longitudinal direction of the metal shell such that the metal shell supports a widthwise inner face of a mating connector. This construction of a connector allows a further reduction in width.

BRIEF DESCRIPTION OF DRAWINGS

FIGS. 5A and 5B are sectional views of the two connectors taken along arrow A-A and arrow B-B shown in FIG. 4;

FIG. 6 is a perspective view of a mating state of the connector shown in FIG. 1, FIG. 2, and the mating connector shown in FIG. 3;

FIGS. 7A and 7B are sectional views of the two connectors taken along arrow A-A and arrow B-B shown in FIG. 6;

FIGS. 8A and 8B are external perspective views of a second embodiment of a connector of the present invention;

FIGS. 12A and 12B are sectional views of the two connectors taken along arrow A-A and arrow B-B shown in FIG. 11;

FIGS. 14A and 14B are sectional views of the two connectors taken along arrow A-A and arrow B-B shown in FIG. 13.

DETAILED DESCRIPTION OF EMBODIMENTS

Figure 1:
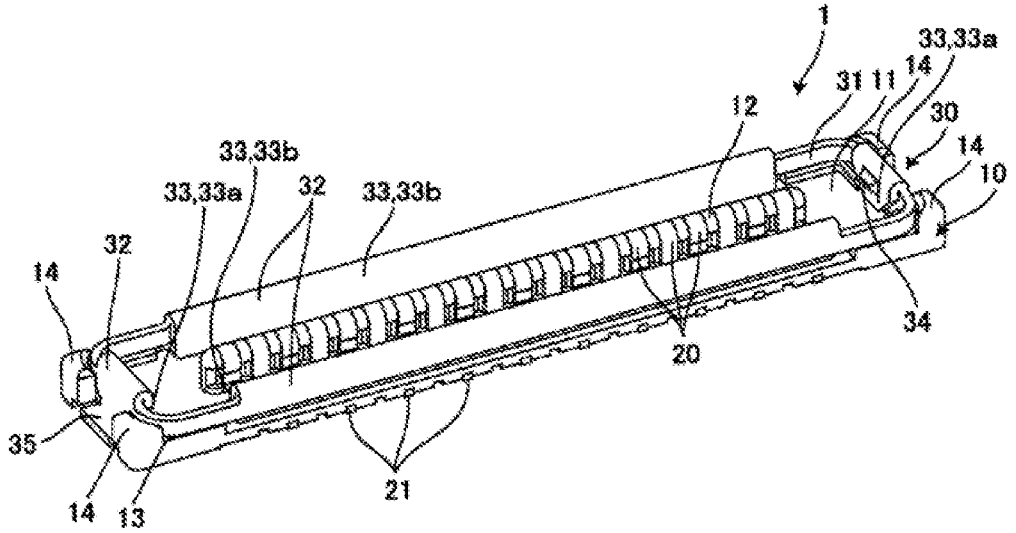
FIG. 1 is an external perspective view of a connector as a first embodiment of the present invention.
Figure 2:
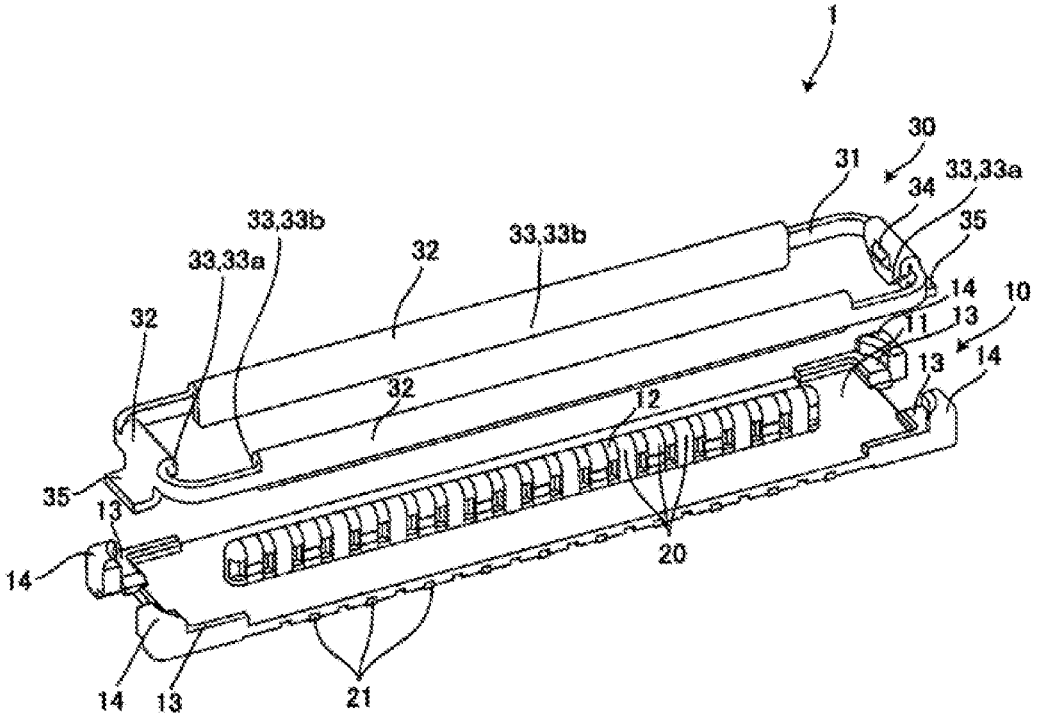
FIG. 2 is an exploded perspective view of the connector shown in FIG. 1.

Referring to FIG. 1 and FIG. 2, the connector 1 is provided with an insulative housing 10. The insulative housing 10 has, in an upper face shown in FIG. 1 and FIG. 2, a mating face 11 formed in a substantially rectangular shape configured to be mated with a mating connector.

In addition, this insulative housing 10 is formed with a mating ridge 12 projecting upward (toward the mating connector during mating) from the mating face 11 and extending in a longitudinal direction of the mating face 11. In the mating ridge 12, a plurality of contacts 20 are arranged. These contacts 20 are integrally molded with the insulative housing 10. In a lower face, not shown, of the insulative housing 10, soldering portions 21 of these contacts 20 are aligned. The soldering portions 21 extend alternately right and left in the lower face of the insulative housing 10 along the arrangement of the contacts 20. The soldering portions 21 are soldered to a circuit board (not shown) on which this connector 1 is mounted.

In addition, this connector 1 is provided with a metal shell 30. The metal shell 30 in this embodiment is composed of a single part that is entirely integrally continuous and it is formed via a drawing process and a bending process. The metal shell 30 has a base portion 31, a curved portion 32, and supporting portions 33. The base portion 31 has a shape upstanding from a peripheral edge of the mating face 11 of the insulative housing 10, extending along the peripheral edge, and enclosing the mating face 11 circumferentially in a substantially rectangular shape. In addition, the curved portion 32 is continuous from an upper end of the base portion 31 and curved inward in a semicircular shape. Since having this semicircular curved shape, the curved portion 32 plays a role that guides the mating connector that is about to be mated easily to a correct mating position.

As indicated above, in this preferred embodiment of the present invention, metal shell 30 is an integrally formed single part. When the metal shell is composed of a single part, alignment with higher precision with the insulative housing 10 is allowed as compared with a case where the metal shell is composed of a combination of a plurality of parts, so that it is possible to guide the mating connector to a more precise position.

Further, the supporting portions 33 each have a shape hanging from the curved portion 32 toward the mating face 11 of the insulative housing 10 along an inner wall face of the base portion 31. The supporting portions 33 play a role that supports the mating connector mated. The supporting portions 33 each form a metal plate having a double thickness in combination with the base portion 31, thereby reinforcing this portion. Thereby, a structure that supports the mating connector further firmly is made.

In addition, the curved portion 32 and the supporting portion 33 of this metal shell 30 are formed in regions excluding four corners of the substantially rectangular shape of the base portion 31. The regions at the four corners of this metal shell 30 are formed only of the base portion 31 excluding the curved portion 32 and the supporting portion 33. For this reason, a mating connector receiving width is wider in both longitudinal end portions composed only of the base portion 31 than in a middle portion.

Furthermore, at supporting portions 33*a* in both the longitudinal end portions of this metal shell 30, lock portions 34 projecting inward (see FIG. 5 and FIG. 7 in combination) are formed. These lock portions 34 play a role that locks the mating connector in a mating state. Furthermore, at both the longitudinal end portions of this metal shell 30, soldering portions 35, continuous to a lower end of the base portion 31 and extending horizontally, are formed. The soldering portions 35 are soldered to a circuit board (not shown) on which this connector 1 is mounted together with the soldering portions 21 of the contacts 20. Then, the soldering portions 35 firmly fix the connector 1 to the circuit board by soldering.

In this regard, both widthwise side portions of the mating connector mated are supported so as to be held from both sides by longitudinally extending supporting portions 33*b*, namely, supporting portions 33*b* located on both widthwise sides of the supporting portions 33 of the metal shell 30. However, in the insulative housing 10 of the present embodiment, upstanding walls extending along side faces of the supporting portions 33*b* of the metal shell 30 that support both side faces of the mating connector are not formed. That is, the supporting portions 33*b* of the metal shell 30 of this portion each has a structure that supports both the widthwise side faces of the mating connector alone without support from the insulative housing 10.

The connector 1 of the present embodiment realizes a reduction in width by achieving this structure, that is, a structure that supports the mating connector from both the widthwise sides by means of the metal shell 30 without forming upstanding walls along the side faces of the supporting portions 33*b* of the metal shell 30 in the insulative housing 10.

In addition, since the connector 1 of the present embodiment achieves a structure that guides the mating connector to a correct mating position by providing the above-described curved portion 32 in the metal shell 30, a structure that facilitates mating with the mating connector is realized while realizing a reduction in width is achieved.

In the insulative housing 10, L-shaped mounting portions 13 sectioning four corners of the substantially rectangular mating face and upstanding therefrom, respectively, are formed. The metal shell 30 is fixed to the insulative housing 10 in an attitude where four corners of the base portion 31 thereof are placed on these mounting portions 13. In the insulative housing 10, at four corner portions that are located closer to the four corners than the L-shaped mounting portions 13 at the four corners, holding portions 14 that hold the metal shell 30 are formed. The metal shell 30 is a little firmly fitted into a region defined these holding portions 14 at the four corners in a clamping manner. Then, outer faces of the four corners of the base portions 31 of the metal shell 30 are pressed by the holding portions 14, so that the metal shell 30 is held by the insulative housing 10. The metal shell 30 is soldered to the circuit board (not shown) via soldering portions 35 at both the longitudinal ends. For this reason, holding the metal shell 30 by the insulative housing 10 is sufficiently fulfilled only by holding performed by the holding portions 14 at the four corners.

Figure 3:
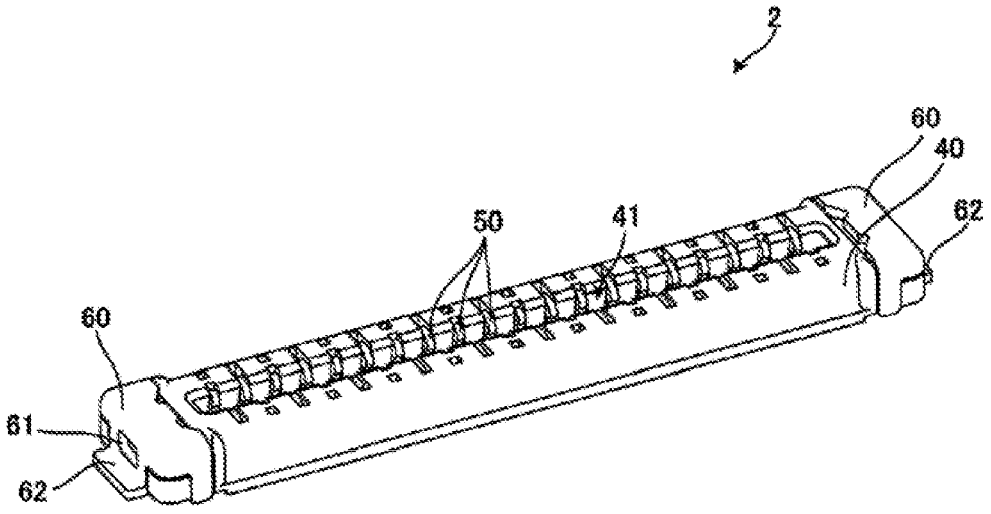
FIG. 3 is an external perspective view of a mating connector.

FIG. 3 is an external perspective view of the mating connector. This mating connector 2 is a connector configured to be mated with the connector of the present embodiment shown in FIG. 1 and FIG. 2. In FIG. 3, the mating connector 2 is shown in an attitude where a mating portion configured to be mated with the connector 1 shown in FIG. 1 and FIG. 2 faces up.

The mating connector 2 is provided with an insulative housing 40, a plurality of contacts 50, and reinforcing metal fittings 60 at both longitudinal ends. In the insulative housing 40, a longitudinally extending mating groove 41 is formed. When the mating connector 2 is mated to the connector 1 shown in FIG. 1 and FIG. 2, the mating ridge 12 disposed in the insulative housing 10 of the connector 1 is fitted into the mating groove 41 disposed in the insulative housing 40 of this mating connector 2.

In the mating groove 41, a plurality of contacts 50 are press-fitted and arranged. When the mating ridge 12 of the connector 1 of FIG. 1 and FIG. 2 is fitted into this mating groove 41, the plurality of contacts 20 of the connector 1 of FIG. 1 and FIG. 2 and the plurality of contacts 50 of this mating connector 2 are electrically connected in contact with each corresponding contacts 20 and 50.

The mating connector 2 is mounted on a circuit board, not shown, in an attitude where a lower face in an attitude shown in FIG. 3 is in contact with the circuit board. The circuit board on which the mating connector 2 is mounted is a circuit board different from the circuit board on which the connector 1 shown in FIG. 1 and FIG. 2 is mounted. On each of the contacts 50, a solder connection portion 51 projecting like a pin (see FIG. 4 and FIG. 6) is disposed. When the mating connector 2 is mounted on the circuit board (not shown), the solder connection portion 51 of the contact 50 is inserted into a hole disposed in the circuit board, and in this state the solder-connection portion 51 is soldered to the circuit board.

In addition, the reinforcing metal fittings 60 are fixed at both longitudinal end portions of the housing 40. In the reinforcing metal fittings 60, lock holes 61 are disposed in longitudinally outward faces. The lock hole 61 is entered by the lock portion 34 disposed in the metal shell 30 of the connector 1 when this mating connector 2 is mated to the connector 1 shown in FIG. 1 and FIG. 2. Then, the entering of the lock portion 34 into the lock hole 61 locks the mating of the connector 1 and the mating connector 2 so that they are not easily parted.

In addition, in the reinforcing metal fittings 60, soldering portions 62 extending horizontally are disposed. The soldering portions 62 are soldered to the circuit board (not shown) on which this mating connector 2 is mounted together with the soldering portions 51 of the contact 50. Then, the soldering portions 62 of the reinforcing metal fittings 60 firmly fix the mating connector 2 to the circuit board by soldering.

In this regard, widthwise dimensions of this mating connector 2 in both the longitudinal end portions having the reinforcing metal fittings 60 attached are wider than a widthwise dimension in a longitudinal middle portion. Both the end portions are fitted into wider portions where the metal shell 30 is formed only of the base portion 31 in both the end portions of the connector 1 shown in FIG. 1 and FIG. 2. Since both the longitudinal end portions of this mating connector 2 are wider, they cannot be fitted into a portion of the metal shell 30 of the connector 1 where the longitudinally extending supporting portions 33*b* are formed. Imagine that both the longitudinal end portions of the mating connector have the same widthwise dimensions as the longitudinal middle portion. That is, imagine that a longitudinal end portion of the mating connector has a widthwise dimension that allows it to fit into the middle portion that is off from both the end portions of the connector 1. Then, while the mating connector 2 is being longitudinally misaligned from the connector 1, the mating connector 2 may be inclined and one end portion of the mating connector 2 may be erroneously mated to the connector 1. When this erroneous mating occurs, the mating ridge 12 or the contacts 20 of the connector 1 may be deformed, which may cause a failure. In the case of the present embodiment, since the four corners of the metal shell 30 are connected only via the base portion 31, both the end portions of the connector 1 are wider, and both the end portions of the mating connector can be fitted only into the wider portions. That is, in the case of the present embodiment, the connectors are prevented from being mated in a longitudinally misaligned state.

Figure 4:
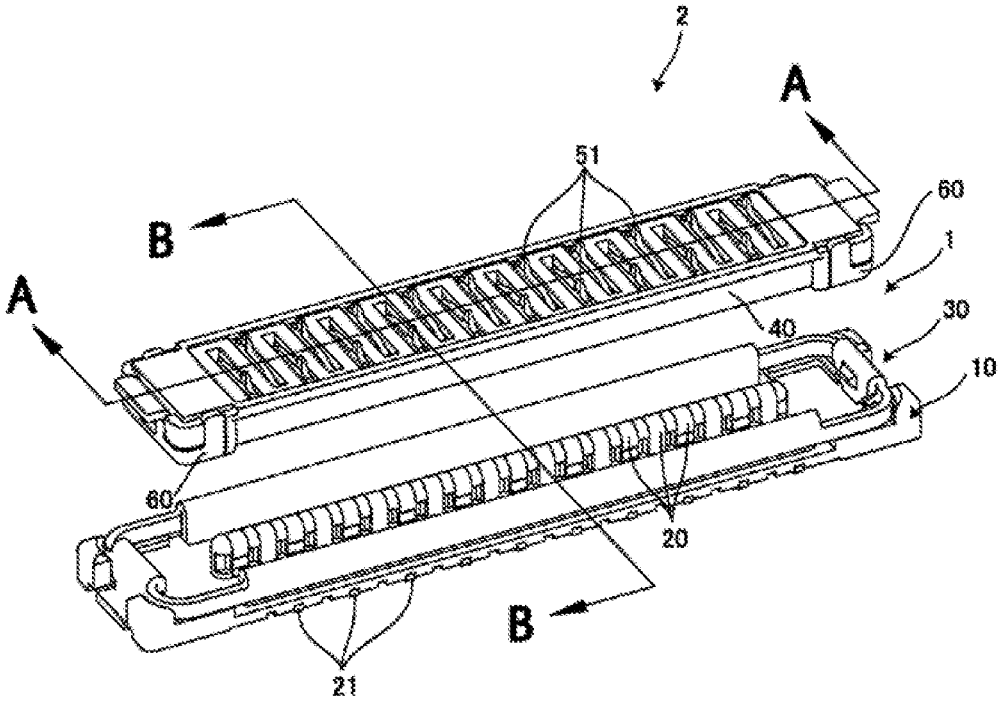
FIG. 4 is a perspective view of a state before mating, showing the connector shown in FIG. 1, FIG. 2 and the mating connector shown in FIG. 3 situated in their mating positions.

FIG. 4 is a perspective view of a state before mating, showing the connector shown in FIG. 1 and FIG. 2, and the mating connector shown in FIG. 3 situated in their mating attitudes. In FIG. 4, since the connectors are situated in their mating attitudes, a lower face of the mating connector 2 is shown facing up.

FIGS. 5A and 5B are sectional views of the two connectors taken along arrow A-A and arrow B-B shown in FIG. 4. In this regard, FIG. 5A is a longitudinal sectional view of the two connectors taken along arrow A-A. On the other hand, FIG. 5B is a widthwise sectional view of the two connectors taken along arrow B-B. The widthwise sectional view of FIG. 5B is shown in an enlarged manner, as compared with in FIG. 4 and FIG. 5A, for the purpose of clarity.

In addition, FIG. 6 is a perspective view of a mating state of the connector shown in FIG. 1 and FIG. 2 and the mating connector shown in FIG. 3.

Furthermore, FIGS. 7A and 7B are sectional views of the two connectors taken along arrow A-A and arrow B-B shown in FIG. 6. In this regard, FIGS. 7A and 7B are views similar to FIGS. 5A and 5B, respectively, except for a difference between the states before and after mating. The sectional view of FIG. 7B is also shown in an enlarged manner, like FIG. 5B, for the purpose of clarity. In FIG. 5A and FIG. 7A, the lock portions 34 disposed in the metal shell 30 of the connector 1 and the lock holes 61 disposed in the reinforcing metal fittings 60 of the mating connector 2 and entered by the lock portions 34 can be seen.

When the mating connector 2 is mated to the connector 1, in terms of the longitudinal direction, the mating is performed such that the reinforcing metal fittings 60 of the mating connector 2 are guided in contact with the curved portions 32 in both the longitudinal ends of the metal shell 30 of the connector 1. Once the connector 1 and the mating connector 2 are mated to each other, the lock portion 34 is fitted into the lock hole 61, so that the mating of the connector 1 with the mating connector 2 is not easily released.

When the mating connector 2 is mated to the connector 1, in terms of the widthwise direction, as shown in FIG. 5B and FIG. 7B, the mating is performed such that the housing 40 of the mating connector 2 is guided in contact with the curved portions 32 in both the widthwise sides of the metal shell 30 of the connector 1. This mating causes the contacts 20 of the connector 1 to fit into the mating groove 41 of the mating connector 2 together with the mating ridge 12 (see FIG. 1 and FIG. 2). Then, the contacts 20 of the connector 1 come into contact with the contacts 50 of the mating connector 2 such that they are pinched from both sides by the contacts 50 of the mating connector 2. It should be noted that, in FIG. 7B, the contact 50 of the mating connector 2 is shown so as to bite into the contact 20, but this is because FIG. 7B shows a shape before elastic deformation. In practice, the contact 50 of the mating connector 2 is caused to elastically expand by the fitting-in of the contact 20, and these contacts 20 and 50 come into contact with each other with a predetermined contact pressure.

Next, a second embodiment of the present invention will be described. FIGS. 8A and 8B are external perspective views of a connector as a second embodiment of the present invention. In this regard, FIG. 8A is a perspective view of an attitude in which a mating face mated with a mating connector (described later) faces up. In addition, FIG. 8B is a perspective view of an attitude in which a lower face which the connector is mounted on a circuit board (not shown) faces up.

Figure 9:
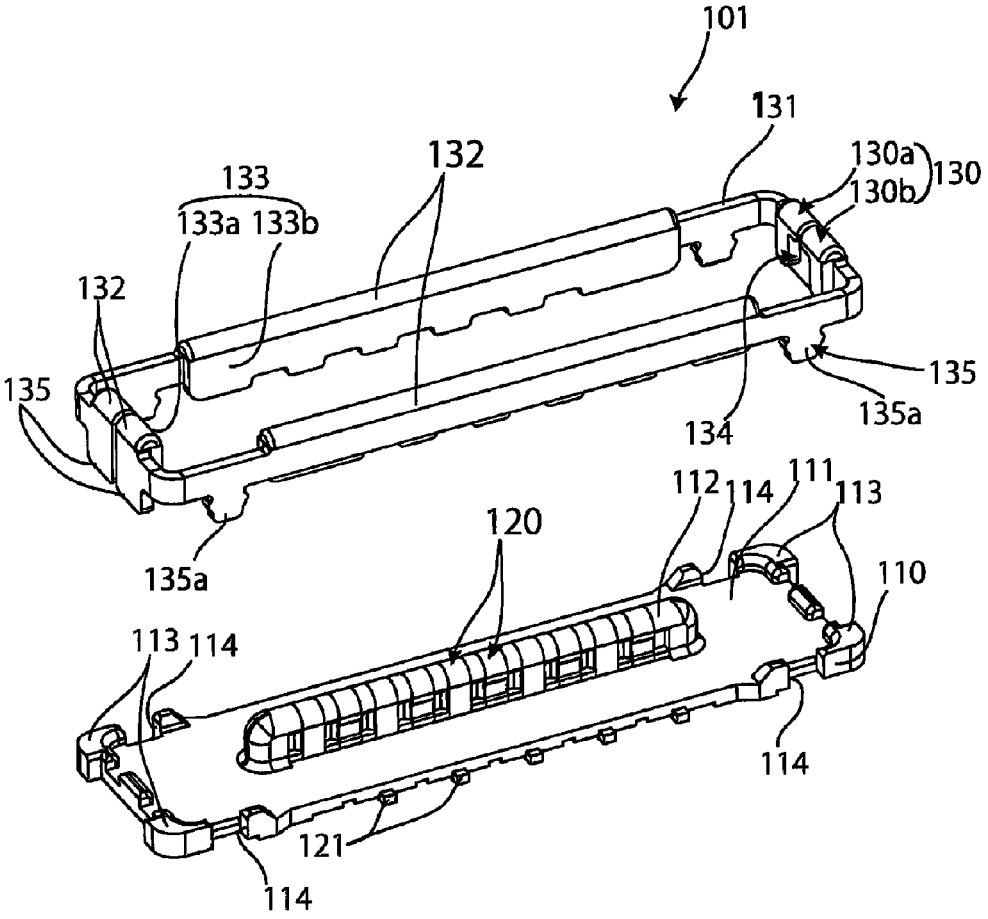
FIG. 9 is an exploded perspective view of the connector shown in FIGS. 8A and 8B.

FIG. 9 is an exploded perspective view of the connector shown in FIGS. 8A and 8B. The connector 101 is provided with an insulative housing 110. The insulative housing 110 has, on an upper face shown in FIG. 8A and FIG. 9, a mating face 111 formed in a substantially rectangular shape configured to be mated with the mating connector.

Further, the insulative housing 110 is formed with a mating ridge 112 projecting upward (toward the mating connector during mating) from the mating face 111 and extending in a longitudinal direction of the mating face 111. In the mating ridge 112, a plurality of contacts 120 are arranged. The contacts 120 are molded integrally with the insulative housing 110. On the lower face of the insulative housing 110 (see FIG. 8B), soldering portions 121 of the contacts 120 are aligned. The soldering portions 121 extend alternately right and left in the lower face of the insulative housing 110 along the arrangement of the contacts 120. The soldering portions 121 are soldered to a circuit board (not shown) on which the connector 101 is mounted.

In addition, the connector 101 is provided with a metal shell 130. The metal shell 130 in the present embodiment is formed via a stamping process and a bending process, unlike the metal shell 30 of the connector 1 of the first embodiment described above. However, the metal shell 30 in the first embodiment described above is a metal shell composed of a single part that is entirely integrally continuous. In contrast, in this preferred embodiment in the present invention, the metal shell 130 is composed of a combination of a plurality of parts (two parts 130*a* and 130*b* as illustrated and being described) separated at centers of both longitudinal ends thereof. These two parts 130*a*, 130*b* have the same shapes as each other. Further, these two parts 130*a* and 130*b* are disposed such that these two parts 130*a* and 130*b* jointly enclose the mating face 111 circumferentially.

When the metal shell 30 is formed as a single part, a drawing process or the like for forming a structure of an opening portion enclosing the mating face of the insulative housing 10 requires man-hours. When the metal shell 130 is composed of a combination of a plurality of parts, it facilitates the manufacture.

The metal shell 130 has a base portion 131, a curved portion 132, and supporting portions 133. The base portion 131 has a shape upstanding from a peripheral edge of the mating face 111 of the insulative housing 110, extending along the peripheral edge, and enclosing the mating face 111 circumferentially in a substantially rectangular shape. In addition, the curved portion 132 is continuous to an upper end of the base portion 131 and curved inward in a semicircular shape. Since having this semicircular curved shape, the curved portion 132 plays a role that guides the mating connector that is about to be mated easily to a correct mating position.

Further, the supporting portion 133 has a shape hanging from the curved portion 132 toward the mating face 111 of the insulative housing 110 along an inner wall face of the base portion 131. The supporting portion 133 plays a role that supports the mating connector mated. The supporting portion 133 forms a metal plate having a double thickness in combination with the base portion 131, thereby reinforcing this part. Thereby, a structure that supports the mating connector further firmly is made.

In addition, the curved portion 132 and the supporting portion 133 of the metal shell 130 are formed in regions excluding four corners of the substantially rectangular shape of the base portion 131. The regions at the four corners of this metal shell 130 are formed only of the base portion 131 excluding the curved portion 132 and the supporting portion 133. For this reason, a mating connector receiving width is wider in both longitudinal end portions composed only of the base portion 131 than in a middle portion.

Further, in supporting portions 133*a* in both the longitudinal end portions of this metal shell 130, recessed portions 134 recessed outward (see FIGS. 12A and 12B, and FIGS. 14A and 14B in combination) are formed. The recessed portions 134 play a role that locks the mating connector in a mating state.

Furthermore, at both the longitudinal end portions of this metal shell 130 and at both side portions in the vicinity of both the end portions, soldering portions 135 extending further downward from a lower end of the base portions 131 are formed. The soldering portions 135 are soldered to a circuit board (not shown) on which this connector 101 is mounted together with the soldering portions 121 of the contacts 120. Then, the soldering portions 135 firmly fix the connector 101 to the circuit board by soldering.

In this regard, both widthwise side portions of the mating connector mated are supported so as to be held from both sides by supporting portions 133*b* extending longitudinally, namely, supporting portions 133*b*, on both widthwise sides, of the supporting portions 133 of the metal shell 130. However, upstanding walls extending along side faces of the supporting portions 133*b* of the metal shell 30 that support both side faces of the mating connector are not formed in the insulative housing 110 of this embodiment. That is, the supporting portions 133*b* of the metal shell 130 of this portion each has a structure that supports both the widthwise side faces of the mating connector alone without support from the insulative housing 110.

The connector 101 of the present embodiment realizes a reduction in width by achieving this structure, that is, a structure that supports the mating connector from both the widthwise sides by means of the metal shell 130 without forming vertical walls formed along side faces of the supporting portions 133*b* of the metal shell 130 in the insulative housing 110. In addition, since the connector 101 of this embodiment achieves a structure that guides the mating connector to a correct mating position by providing the above curved portion 132 in the metal shell 130, a structure that facilitates mating with the mating connector while realizing a reduction in width is achieved.

In the insulative housing 110, L-shaped mounting portions 113 sectioning four corners of the substantially-rectangular mating face and upstanding therefrom, respectively, are formed. The metal shell 130 is fixed to the insulative housing 110 in an attitude where four corners of the base portion 131 are placed on these mounting portions 113. In the insulative housing 110, holding grooves 114 holding the metal shell 130 are disposed on both the side portions in respective positions adjacent to the L-shaped mounting portions 113 at the four corners. In the holding grooves 114, a total of four soldering portions 135*a* of the soldering portions 135 described above, which are formed on the both side portions in the vicinity of longitudinal both end portions, are fitted by light press-fitting into the holding grooves 114 individually corresponding thereto. Thus, the two parts 130*a* and 130*b* constituting the metal shell 130 are held by the insulative housing 110. The soldering portions 135 of the metal shell 130 are soldered to the circuit board (not shown). For this reason, holding of each of the parts 130*a* and 130*b* of the metal shell 130 performed by the insulative housing 110 is sufficiently fulfilled only by holding performed by the two holding grooves 114.

Figure 10:
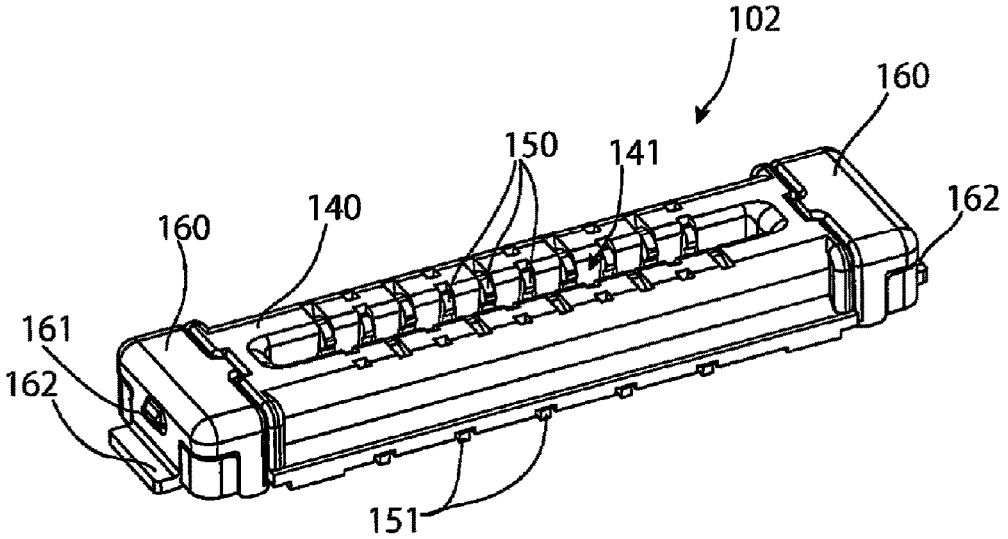
FIG. 10 is an external perspective view of a mating connector.

FIG. 10 is an external perspective view of the mating connector. This mating connector 102 is a connector configured to be mated with the connector of the present embodiment shown in FIGS. 8A and 8B and FIG. 9. In FIG. 10, the mating connector 102 is shown in an attitude where a mating portion configured to be mated with the connector 101 shown in FIGS. 8A and 8B and FIG. 9 faces up. The mating connector 102 is provided with an insulative housing 140, a plurality of contacts 150, and reinforcing metal fittings 160 at longitudinal both ends. In the insulative housing 140, a mating groove 141 extending longitudinally is formed. When the mating connector 102 is mated to the connector 101 shown in FIGS. 8A and 8B and FIG. 9, the mating ridge 112 disposed in the insulative housing 110 of the connector 101 is fitted into the mating groove 141 disposed in the insulative housing 140 of the mating connector 102. In the mating groove 141, the plurality of contacts 150 are press-fitted and arranged. When the mating ridge 112 of the connector 101 of FIGS. 8A and 8B and FIG. 9 is fitted into the mating groove 141, the plurality of contacts 120 of the connector 101 of FIGS. 8A and 8B and FIG. 9 and the plurality of contacts 150 of this mating connector 102 are electrically connected in contact with respective corresponding contacts 120 and 150.

The mating connector 102 is mounted on a circuit board, not shown, in an attitude where a lower face in the position shown in FIG. 10 is in contact with the circuit board. The circuit board on which this mating connector 102 is mounted is a circuit board different from the circuit board on which the connector 101 shown in FIGS. 8A and 8B and FIG. 9 is mounted. On the respective contacts 150, solder connection portions 151 (see FIG. 11 and FIG. 13) extending alternately right and left in a widthwise direction of the insulative housing 140 along a lower face 142 of the insulative housing 140 are provided. When the mating connector 102 is loaded on the circuit board (not shown), the solder connection portions 151 of the contacts 150 are soldered to a surface of the circuit board.

In addition, the reinforcing metal fittings 160 are fixed to both the longitudinal end portions of the housing 140. In the reinforcing metal fittings 160, projecting portions 161 projecting outward are disposed in longitudinally outward faces. The projecting portions 161 enter the recessed portions 134 disposed in the metal shell 130 of the connector 101 when this mating connector 102 is mated to the connector 101 shown in FIGS. 8A and 8B and FIG. 9. Then, the entering of the projecting portion 161 into the recessed portions 134 locks the mating of the connector 101 and the mating connector 102 so that the mating between the connector 101 and the mating connector 102 are not easily released.

In addition, in the reinforcing metal fittings 160, soldering portions 162 extending horizontally are disposed. The soldering portions 162 are soldered to the circuit board (not shown) on which this mating connector 102 is mounted together with the soldering portions 151 of the contact 150. Then, the soldering portions 162 of the reinforcing metal fittings 160 firmly fix the mating connector 102 to the circuit board by soldering. In this regard, widthwise dimensions of this mating connector 102 in both the longitudinal end portions having the reinforcing metal fittings 160 attached are wider than widthwise dimensions in a longitudinal middle portion. Both the end portions are fitted into wider portions in both end portions of the connector 101 shown in FIGS. 8A and 8B and FIG. 9 where the metal shell 130 is formed only of the base portion 131. Since both the longitudinal end portions of this mating connector 102 are wider, they cannot be fitted into portions of the metal shell 130 of the connector 101 where the longitudinally extending supporting portions 133*b* are formed. Imagine that both the longitudinal end portions of the mating connector have the same widthwise dimensions as the longitudinal middle portion. That is, imagine that both the longitudinal end portions of the mating connector have widthwise dimensions allowing them to fit into the middle portion that is off from both the end portions of the connector 101. Then, while the mating connector 102 is being longitudinally misaligned from the connector 101, the mating connector 102 may be inclined and one end portion of the mating connector 102 may be erroneously mated to the connector 101. When this erroneous mating occurs, the mating ridge 112 or the contacts 120 of the connector 101 may be deformed, which may cause a failure. In the case of the present embodiment, since the four corners of the metal shell 130 are formed only of the base portion 131, the connector 101 is wider in both the end portions and both the end portions of the mating connector can be fitted only into the wider portions. That is, in the case of the present embodiment, the connectors are prevented from being mated in a longitudinally misaligned state.

Figure 11:
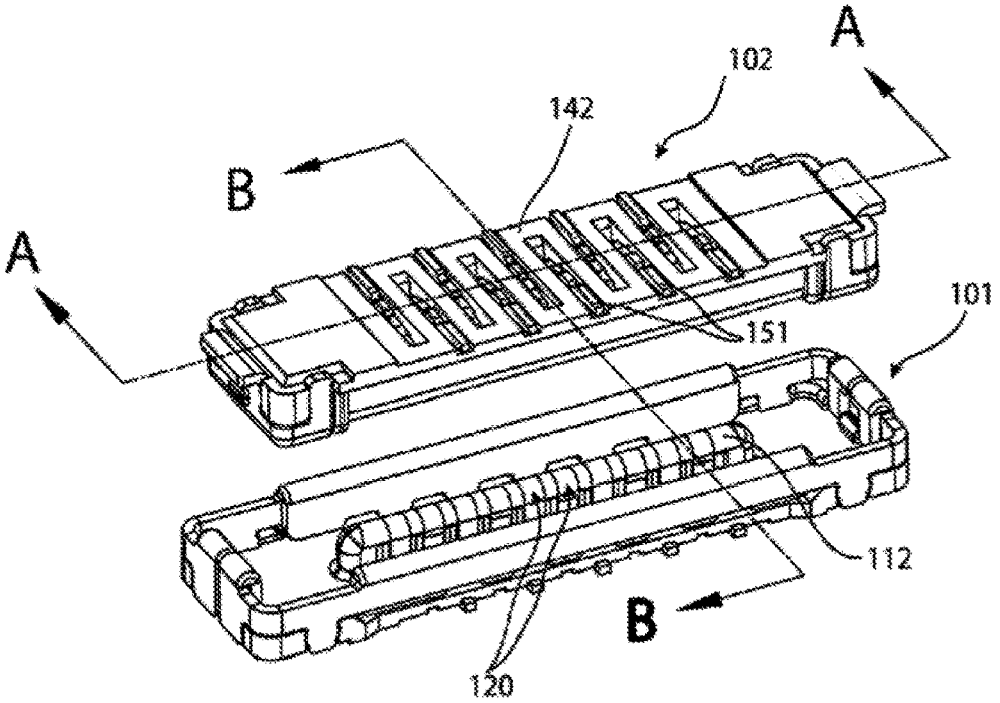
FIG. 11 is a perspective view of a state before mating, showing the connector shown in FIGS. 8A and 8B, FIG. 9 and the mating connector shown in FIG. 10 in their mating positions.

FIG. 11 is a perspective view of a state before mating, showing the connector shown in FIGS. 8A and 8B, and FIG. 9, and the mating connector shown in FIG. 10 situated in their mating attitudes. In FIG. 11, since the connectors are situated in their mating attitudes, the lower face of the mating connector 102 is shown facing up.

FIGS. 12A and 12B are sectional views of the two connectors taken along arrow A-A and arrow B-B shown in FIG. 11. In this regard, FIG. 12A is a longitudinal sectional view of the two connectors taken along arrow A-A. On the other hand, FIG. 12B is a widthwise sectional view of the two connectors taken along arrow B-B. The widthwise sectional view of FIG. 12B is shown in an enlarged manner, as compared with in FIG. 11 and FIG. 12A, for the purpose of clarity.

Figure 13:
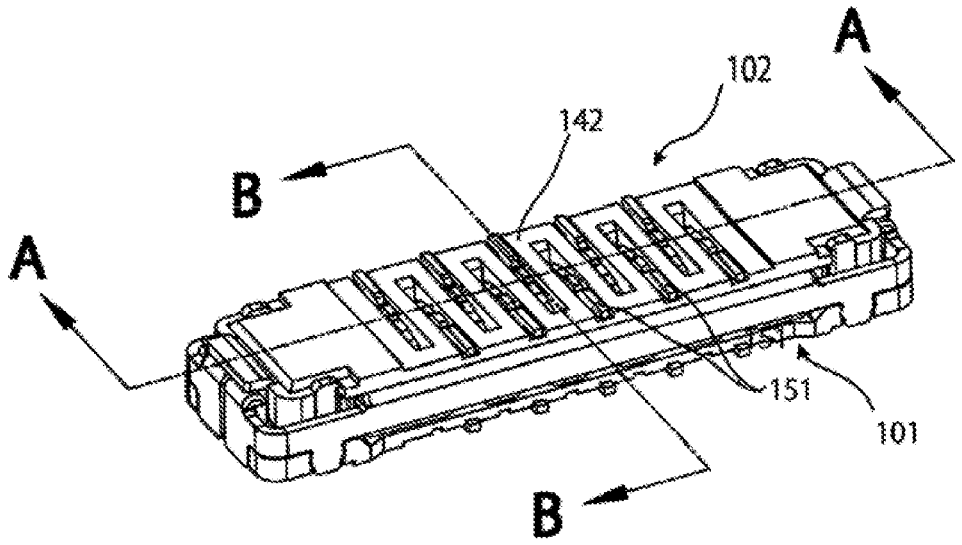
FIG. 13 is a perspective view of a mating state of a connector shown in FIGS. 8A and 8B, FIG. 9 and the mating connector shown in FIG. 10.

In addition, FIG. 13 is a perspective view of a mating state of the connector shown in FIGS. 8A and 8B and FIG. 9 and the mating connector shown in FIG. 10.

Furthermore, FIGS. 14A and 14B are sectional views of the two connectors taken along arrow A-A and arrow B-B shown in FIG. 13. FIGS. 14A and 14B are views similar to FIGS. 12A and 12B, respectively, except for a difference between the states before and after mating. The sectional view of FIG. 14B is also shown in an enlarged manner, like FIG. 12B, for the purpose of clarity.

In FIG. 12A and FIG. 14A, the recessed portions 134 disposed in the metal shell 130 of the connector 101 and the projecting portions 161, disposed on the reinforcing metal fittings 160 of the mating connector 102 and entering the recessed portions 134, can be seen. When the mating connector 102 is mated to the connector 101, in terms of the longitudinal direction, the mating is performed such that the reinforcing metal fittings 160 of the mating connector 102 are guided in contact with the curved portions 132 in both the longitudinal ends of the metal shell 130 of the connector 101. Once the connector 101 and the mating connector 102 are mated with each other, the projecting portions 161 are fitted into the recessed portions 134, so that the mating of the connector 101 with the mating connector 102 is not easily released.

When the mating connector 102 is mated to the connector 101, in terms of the widthwise direction, as shown in FIG. 12B and FIG. 14B, the mating is performed such that the housing 140 of the mating connector 102 is guided in contact with the curved portions 132 in both the widthwise sides of the metal shell 130 of the connector 101. This mating causes the contacts 120 of the connector 101 to fit into the mating groove 141 of the mating connector 102 together with the mating ridge 112 (see FIGS. 8A and 8B and FIG. 9). Then, the contacts 120 of the connector 101 come into contact with the contacts 150 of the mating connector 102 such that the contacts 120 are pinched from both sides by the contacts 150 of the mating connector 102. It should be noted that, in FIG. 14B, the contact 150 of the mating connector 102 is shown so as to bite into the contact 120, but this is because FIG. 14B shows a shape before elastic deformation. In practice, the contact 150 of the mating connector 102 is caused to elastically expand by the fitting-in of the contact 120, and these contacts 120 and 150 come into contact with each other with a predetermined contact pressure.

It should be noted that, in the first embodiment described before, the connector 1 having twenty contacts 20 arranged in the longitudinal direction is shown. On the other hand, in the second embodiment, the connector 101 having ten contacts 120 arranged in the longitudinal direction is shown. However, the number of contacts arranged is not limited to twenty or ten, but any number of contacts may be disposed. A longitudinal dimension of a connector is adjusted according to the number of contacts arranged. On the other hand, in terms of a widthwise dimension of the connector, a reduction in width is maintained regardless of the number of contacts arranged in the longitudinal direction.

What is claimed is:

1. A connector comprising:

an insulative housing having a mating face;

a plurality of contacts arranged in a longitudinal direction and supported by the insulative housing; and a metal shell adapted to support a widthwise inner face of a mating connector and having:

(a) a base portion:

(1) extending along a peripheral edge of the mating face of the insulative housing, (2) upstanding from the peripheral edge of the mating face of the insulative housing, and (3) enclosing circumferentially the mating face of the insulative housing, (b) a curved portion continuous to an upper end of the base portion and curved inward in a semicircular shape adapted to guide a mating connector, and (c) a supporting portion:

(1) extending from the curved portion toward the mating face of the insulative housing and abutting along an inner wall face of the base portion adapted to support the mating connector, (2) extending along the peripheral edge of the mating face of the insulative housing, and (3) enclosing the mating face of the insulative housing circumferentially.

2. A connector according to claim 1 wherein:

(a) the mating face of the insulative housing is substantially rectangular, and (b) the supporting portion of the metal shell encloses the mating face of the insulative housing in a substantially rectangular shape.

3. The connector according to claim 1, wherein:

(a) the curved portion of the metal shell and the supporting portion of the metal shell are in a region of the base portion excluding regions at four corners of the substantially rectangular shape of the base portion of the metal shell, and (b) the regions at the four corners of the base portion of the metal shell are formed only of the base portion excluding the curved portion and the supporting portion.

4. The connector according to claim 1, wherein the metal shell is an integrally formed single part.

5. The connector according to claim 2, wherein the metal shell is an integrally formed single part.

6. The connector according to claim 3, wherein the metal shell is an integrally formed single part.

7. The connector of claim 1 wherein the metal shell is composed of a combination of a plurality of parts.

8. The connector of claim 7, wherein the metal shell is composed of a combination of two parts separated at centers in both longitudinal ends and having an identical shape.

9. The connector of claim 1, wherein the curved portion and the supporting portion of the metal shell are disposed along portions of the insulative housing which consist only of the mating face.

10. The connector of claim 9, wherein the insulative housing does not have a portion extending perpendicular to the mating face adjacent the curved portion and the supporting portion of the metal shell.

11. The connector of claim 9, wherein only the base portion and the supporting portion of the metal shell extend in a direction perpendicular to the mating face along a pair of longitudinal sides of the insulative housing.

* * * * *